US005536229A

United States Patent [19]

Albergo

[11] Patent Number: 5,536,229

[45] Date of Patent: Jul. 16, 1996

[54] ADJUSTABLE STRETCHING EXERCISE DEVICE

[75] Inventor: George N. Albergo, North Hollywood, Calif.

[73] Assignee: Phsyical Success, Inc., North Hollywood, Calif.

[21] Appl. No.: 370,295

[22] Filed: Jan. 6, 1995

[51] Int. Cl.[6] ..... A63B 26/00

[52] U.S. Cl. ..... 482/148; 482/83

[58] Field of Search ..... 482/91, 148, 907, 482/33, 904, 83, 33; 248/354.5, 125

[56] References Cited

U.S. PATENT DOCUMENTS 2,937,842 5/1960 Meek ..... 248/354.5

5,149,174 9/1992 Charash ..... 248/125

5,352,170 10/1994 Condo et al. ..... 482/83

*Primary Examiner*—Stephen R. Crow

*Attorney, Agent, or Firm*—Michaelson & Wallace

[57] ABSTRACT

The present invention discloses an adjustable stretching device for stretching numerous muscles of the human body comprising a plurality of adjustable telescoping poles adaptable to extend within the span between the floor and most standard ceilings or doorways. Attached to the center telescoping pole is an adjustable leg support extending from both sides of the center pole. The leg support includes a clamp mechanism for easily and quickly adjusting the placement of the leg support on the center pole to effectuate numerous stretching exercises.

15 Claims, 1 Drawing Sheet

ADJUSTABLE STRETCHING EXERCISE DEVICE

BACKGROUND OF THE INVENTION

1. Field of the Invention

This invention relates in general to exercise devices, and in particular, to stretching devices to aid human physical development.

2. Description of the Related Art

With the growing popularity of cardiovascular activities such as tennis, swimming, aerobics, martial arts, etc., health enthusiasts have been prompted to protect their bodies from injuries caused by the respective activity as well as to enhance the results obtained from the activity. It is well known that muscle stretching before and after engaging in any physical activity is essential to properly safeguard from bodily injuries caused by the activity. Beginning a physical activity or exercise routine without adequate stretching can result in pulled muscles and torn ligaments. Also, muscle stretching enhances the results obtained from the activity. Thus, muscle stretching before and after engaging in the physical activity has become very popular because muscle stretching is the most efficient way to prevent bodily injuries and to enhance results from the activity.

Stretching exercises lengthen and strengthen the muscles. Also, stretching improves flexibility and balance. After thoroughly and properly stretching important muscles and body parts, exercises can be performed with agile movements, rather than with hard and rigid movements. In addition, because stretching improves flexibility, it can also enhance kicking power, balance, and radius for martial arts. Further, stretching after engaging in a physical activity reduces muscle soreness and stiffness. Being limber can also improve everyday life since many have to lift objects, bend over, and remain seated for extended periods of time. Agility and flexibility prepares and conditions the body for the everyday strains on the muscle groups.

There are numerous stretching exercise devices available, however, most are cumbersome, expensive, and do not adequately stretch out all the muscle groups that are essential to properly prevent bodily injuries as well as enhance the results obtained from the physical activity. For example, a seated crank is one type of stretching device that is currently available. The device is first placed on the ground in a "v" shape. The legs are then placed into the device, where they are held by two straps, and then a crank is rotated to widen the "v", thus, stretching out the legs. However, this device has several drawbacks. First, as the "v" is widened only the inner thigh is stretched. Second, since the device is performed while sitting and does not require standing on one leg while stretching the other leg, it does not improve one's balance. Third, the device is comprised of several bulky components and is inconvenient to store and assemble. Further, this device is very expensive.

Another stretching device is a pulley type and is comprised of three long posts and rests on the floor. At the top of the post is a rope and a pulley mechanism. The foot is placed into the harness which is attached to the rope. The leg is then pulled up and down by hand. However, this device has several disadvantages. First, this device is not portable and is extremely bulky. Second, this device primarily stretches out the hips and does not stretch out the side muscles or obliques, muscles which are involved in most physical activities. Third, this device could be dangerous if the pulley jams and the leg becomes trapped in midair. Further, this device is extremely expensive.

Another stretching device is a parallel bar type which is attached between the doorways. Parallel bars form the frame of the device while a third bar, which is horizontal to the parallel bars, protrudes from the parallel bars, and is attached to the horizontal bar as a sling suspended by chains. The horizontal bar is grasped by both hands and one foot is placed in the sling and the other foot directly underneath the machine's frame. The body is leaned forward until the arms are straight overhead and the leg in the sling is straightened out. Although this device stretches more areas than the devices discussed above, this device has numerous drawbacks. First, this device is extremely bulky and is not portable. Second, since this device is very large and awkward and requires a spacious room. Third, this device can be dangerous, often requires supervision by another, and is not suitable for people of all ages. Further, this device is extremely expensive.

Therefore, what is needed is a universal device that will stretch all important muscles and provide agility, balance, and flexibility. Also, a portable stretching device that is not bulky and cumbersome is needed. In addition, a stretching device that is safe and allows use by people of all ages is needed. Further, an inexpensive stretching device is needed.

Whatever the merits of the systems described above, they do not achieve the objectives and advantages of the present invention.

SUMMARY OF THE INVENTION

To overcome the limitations in the prior art described above, and to overcome other limitations that will become apparent upon reading and understanding the present specification, the present invention discloses an adjustable stretching device for stretching numerous muscles of the human body. The present invention is comprised of a plurality of adjustable telescoping poles adaptable to extend within the span between the floor and most standard ceilings or doorways. The telescoping poles are fitted with an adjustable radial compression nut for easily and quickly adjusting the total extension of the device and for providing secure stability. The top telescoping pole includes a rubber end cap fitted to engage with a mounted ceiling cup. The bottom telescoping pole also includes a rubber end cap that rests on the floor or ground. Attached to the center telescoping pole is an adjustable leg support. The leg support laterally extends from both sides of the center pole. Each side of the leg support has a cushion or foam roller to provide comfort to the user. The leg support includes a clamp mechanism for easily and quickly adjusting the placement of the leg support on the center pole.

A feature of the present invention is that it stretches all important muscles. Another feature of the present invention is that it helps the user obtain agility, balance, and flexibility. Yet another feature of the present invention is that it is portable and not bulky and cumbersome. An advantage of the present invention is that it is safe. Another advantage of the present invention is that it can be used by people of all ages. Yet another advantage of the present invention is that it is inexpensive.

DETAILED DESCRIPTION OF THE INVENTION

In the following detailed description of the preferred embodiment, reference is made to the drawings which form a part hereof, and in which is shown by way of illustration a specific embodiment in which the invention may be practiced. It is to be understood that other embodiments may be utilized and structural changes may be made without departing from the scope of the invention.

Figure 1:
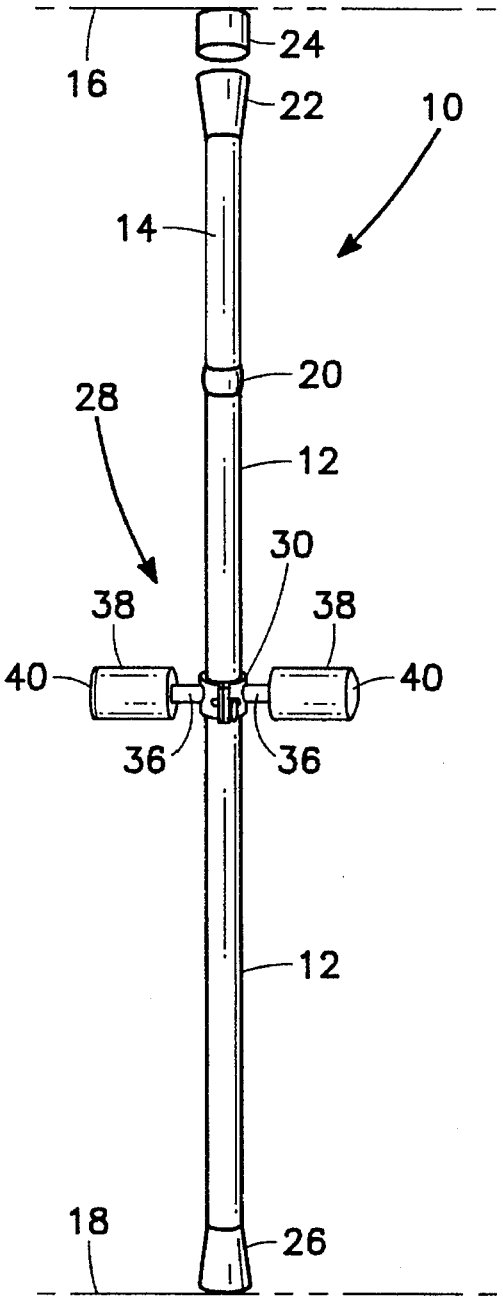
FIG. 1 illustrates a perspective view of one example of the stretching device in accordance with the present invention.

FIG. 1 illustrates a perspective view of one example of the stretching device 10 in accordance with the present invention. The adjustable stretching device 10 stretches numerous muscles of the human body. Muscle stretching before and after engaging in any physical activity is essential to enhance the results obtained from the activity as well as properly safeguard and condition the human body. Lack of adequate stretching can result in pulled muscles, torn ligaments and numerous other muscle related injuries.

An elongated center telescoping pole 12 is coupled to a plurality of nested telescoping poles 14. The telescoping poles 14 are incrementally smaller elongated sections that extend and retract within each other. The telescoping poles 12 and 14 are fitted with an adjustable radial compression nut 20 for easily and quickly adjusting the total extension of the stretching device 10 and for providing secure stability of the device 10 during usage. The compression nut 20 is radially loosened when the total extension of the device 10 through the telescoping poles 12 and 14 is to be adjusted. Conversely, the compression nut 20 is radially tightened when the telescoping poles 12 and 14 of the device 10 are to be securely stabilized during usage.

Figure 2:
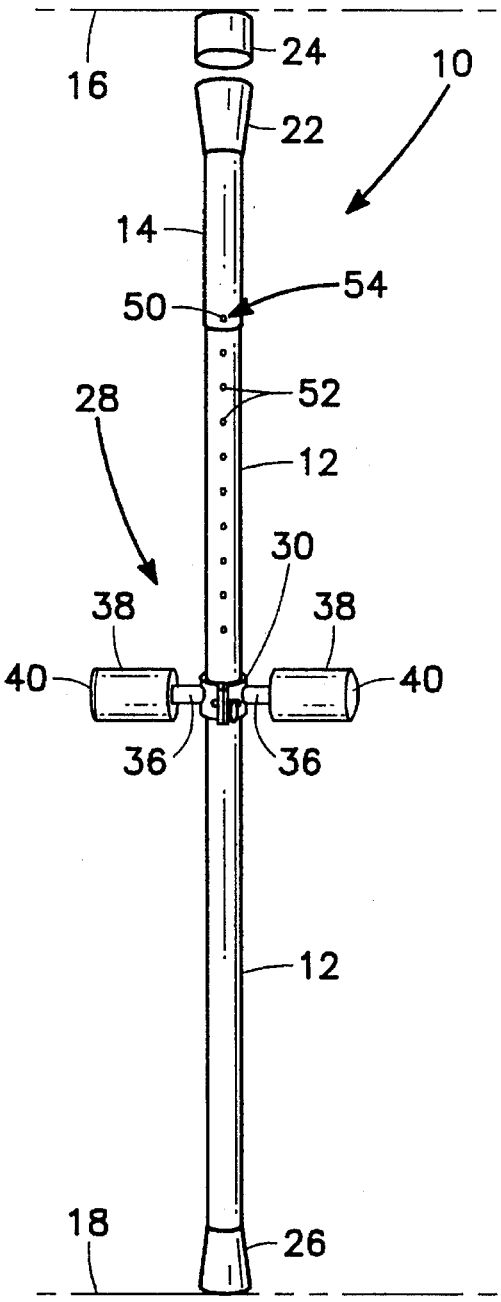
FIG. 2 illustrates a perspective view of another example of the stretching device in accordance with the present invention.

FIG. 2 illustrates a perspective view of an alternative embodiment of the stretching device 10 in accordance with the present invention. Instead of fitting the telescoping poles 12 and 14 with an adjustable compression nut 20, the outer telescoping pole 14 has a master hole 50 and the center telescoping pole 12 has a plurality of matching holes 52. A pin 54 is placed in the master hole 50 and a matching hole of the center telescoping pole 12 to lock the poles 12 and 14 within each other. This allows quick and easy adjustment of the total extension of the stretching device 10 and provides secure stability of the device 10 when being used.

Referring back to FIG. 1, the stretching device 10 is adaptable to extend within the span between most standard ceilings 16 or doorways and the floor 18 or ground. The outer telescoping pole 14 includes a rubber end cap 22. A ceiling mount cup 24 is fitted to receive the rubber end cap 22 so that the stretching device is removably coupled to the ceiling 16 at the ceiling mount cup 24. The center telescoping pole 12 also includes a rubber end cap 26 that safely rests on the floor 18. The increased friction created by the rubber end caps 24 and 26 provides safe and stable attachment to the ceiling 16 and floor 18 respectively. In addition, since the rubber end cap 18 is rubber, it will not scratch or damage the floor 18.

An adjustable leg support 28 is slidably attached to the center telescoping pole 12. The leg support 28 includes a clamp mechanism or ring clamp 30 for clamping the leg support 28 to the center telescoping pole 12. The ring clamp 30 includes a latch mechanism 34 for easily and quickly adjusting the placement of the ring clamp 30 of the leg support 28 on the center pole 12. The latch mechanism 34 also provides safe and secure clamping of the leg support 28 to the device 10 during usage of the device 10.

Figure 3:
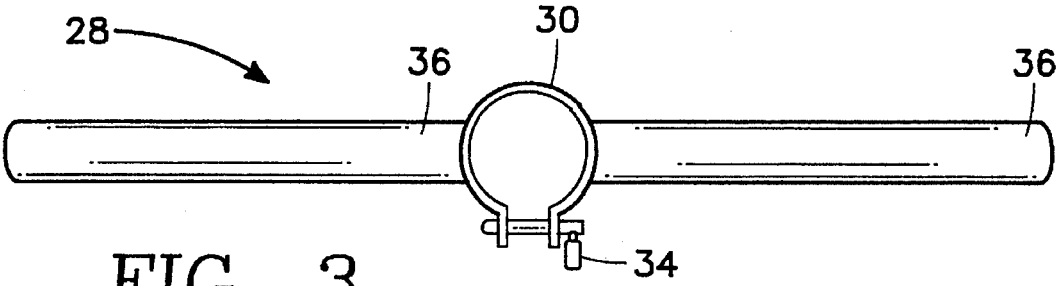
FIG. 3 is a top view of the device of FIGS. 1 and 2 employing the clamp mechanism arrangement of the leg support.

FIG. 3 is a top view of the device 10 of FIGS. 1 and 2 employing the clamp mechanism or ring clamp 30. The ring clamp 30 can utilize a radial compression latch mechanism 34 that radially extends the ring clamp 30 when loosened and radially compresses the ring clamp 30 when tightened. This compression quickly and easily provides adjustment and secure stability, respectively, of the leg support 28 on the device 10.

The clamp mechanism 30 can also be a pin with matching holes arrangement. The center pole 12 can have holes 52 as shown in FIG. 2. The holes 52 of the center pole are fitted to receive a pin latch mechanism 34 of the clamp mechanism 30 for quick and easy adjustment of the leg support 28.

Referring back to FIG. 1, a center shaft 36 laterally extends from each side of the ring clamp 30. Each center shaft 36 of the leg support 28 has a foam roller 38 or cushion with a decorative end cap 40. The foam rollers 38 provide the user comfort when resting body parts on the leg support 28 while performing exercises with the stretching device 10.

The stretching device 10 of the present invention stretches all important muscles and helps the user obtain agility, balance, and flexibility. In addition, the stretching device 10 of the present invention is portable and not bulky and cumbersome. Further the stretching device 10 of the present invention is safe and can be used by people of all ages.

SAMPLE EXERCISES

The following are sample exercise that can be performed with the stretching device 10 of the present invention. One example is the hamstrings stretch. The leg support 28 is first adjusted to hip level. Next, the leg is extended toward the leg support 28 so that the heel is placed on the cushion 38 of the leg support 28, while the other leg is firmly on the ground 18. The upper torso is bent toward the extended leg, and the hand is reached toward the of the toes of the extended leg. When one leg is done, the stretching exercise is repeated on the other leg.

The hamstrings can also be stretched to improve balance by performing high kicks with the stretching device 10 of the present invention. One should begin by standing next to the stretching device 10. The device 10 is then grasped with the hand closest to the device 10. Next, the leg opposite the hand grasping the device 10 is kicked upward. Kicking can be performed based on the experience of the user.

Another sample exercise for use with the stretching device 10 of the present invention is to stretch the obliques. While standing with both feet firmly on the ground 18 and shoulder width apart, the device 10 is placed across the back of the shoulders. The arms rest on the center pole 12 and are extended out to the ends of the device 10. While keeping the back straight, head up, and the lower body completely stationary, the body is slowly twisted to the right, then back to the center, and then to the left. In addition, instead of twisting, one can bend to the right while keeping the back straight, return to the starting position, and then bend to the left for stretching the side muscles.

The side muscles can also be stretched by standing next to the device 10 with both feet together and firmly on the ground 18 while placing the hand closest to the device 10 on the device 10. The other hand is stretched to reach the highest point possible on the device 10. This exercise is then repeated on the other side of the body.

Another sample exercise is to stretch the inner thighs and lower back. While sitting on the floor with the legs in a "v" position, the device 10 is placed at the bottom of both feet. One then reaches toward the device 10, the chest is pulled toward the floor 18, and the device 10 is grasped with the hands. The head should be moving down evenly with the shoulders. After lifting oneself, one stretches to the right leg, then goes back to the center, and then stretches to the left leg.

Yet another example exercise is the stomach and back stretch. First, the leg support 28 is adjusted appropriately, and then the leg is placed over the leg support 28 and locked into position. The foam cushion 38 is then grasped with the hands and the body is bent toward the device 10 to thereby stretch the torso and back muscles.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An exercise device for stretching muscles of the human body, comprising:

an elongated adjustable shaft comprising a plurality of telescoping elongated sections including a plurality of incrementally smaller elongated sections that extend and retract within each other and means for locking and adjusting said plurality of elongated sections within each other; and an adjustable transverse support consisting essentially of a plurality of rigid integral spaced apart leg supports laterally extending on opposite sides of said transverse support and from said elongated shaft and including an integral locking clamp mechanism slidably coupled to said elongated shaft for adjusting the placement of said transverse support on said elongated shaft and for locking said transverse support thereon.

2. The invention as set forth in claim 1, wherein said locking clamp mechanism is a compression clamp utilizing radial compression to lock said transverse support onto said elongated shaft.

3. The invention as set forth in claim 2, wherein said means for locking is a compression ring mechanism utilizing radial compression to lock said elongated sections within each other.

4. The invention as set forth in claim 1, further comprising a floor mount detachably connected to a floor for receiving said distal end of said elongated shaft.

5. The invention as set forth in claim 1, further comprising rubber end caps located on opposite ends of said elongated shaft.

6. The invention as set forth in claim 1, further comprising a plurality of cushion pads removably attached to said plurality of leg supports for comfortably supporting body parts.

7. An exercise device for stretching muscles of the human body, comprising:

a ceiling mount coupled to a ceiling;

an elongated adjustable shaft, removably coupled to said ceiling at said ceiling mount at a proximal end of said elongated shaft and between a floor at a distal end of said elongated shaft, comprising a plurality of telescoping elongated sections including a plurality of incrementally smaller elongated sections that extend and retract within each other;

means for locking and adjusting said plurality of elongated sections within each other; and an adjustable transverse support consisting essentially of a plurality of rigid integral laterally spaced apart leg supports extending on each side of said transverse support and including integral locking means slidably coupled to said elongated shaft for adjusting the placement of said transverse support on said elongated shaft and for locking said transverse support thereon.

8. The invention as set forth in claim 7, further comprising a floor mount detachably connected to the floor for receiving said distal end of said elongated shaft.

9. The invention as set forth in claim 7, further comprising rubber end caps located on said proximal end and said distal end of said elongated shaft.

10. The invention as set forth in claim 7, further comprising a plurality of cushion pads removably attached to said plurality of leg supports for comfortably supporting body parts.

11. The invention as set forth in claim 7, wherein the integral locking means is a compression clamp mechanism utilizing radial compression, wherein said transverse support is locked to said device when said compression clamp is tightened and wherein said transverse support is slidably adjustable on said device when said compression clamp is loosened.

12. The invention as set forth in claim 7, wherein the means for locking and adjusting said plurality of elongated sections are a plurality of holes in each elongated section, wherein a pin is placed in matching holes of said elongated sections to lock said elongated sections within each other.

13. The invention as set forth in claim 7, wherein the integral locking means is a compression ring mechanism utilizing radial compression, wherein said elongated sections are locked within each other when said compression ring is tightened and wherein said elongated sections are slidably adjustable within each other when said compression ring is loosened.

14. The invention as set forth in claim 7, wherein the locking means is a plurality of holes in said elongated shaft, wherein a pin is placed in a matching hole of said elongated shaft to lock and adjust said leg support to said elongated shaft.

15. An exercise device for stretching muscles of the human body, comprising:

a ceiling mount coupled to a ceiling;

an elongated adjustable shaft, removably coupled to said ceiling at said ceiling mount at a proximal end of said elongated shaft and between a floor at a distal end of said elongated shaft, comprising a plurality of telescoping elongated sections including a plurality of incrementally smaller elongated sections that extend and retract within each other;

a compression ring mechanism utilizing radial compression for locking and adjusting said plurality of elongated sections within each other, wherein said elongated sections are locked within each other when said compression ring is tightened and wherein said elongated sections are slidably adjustable within each other when said compression ring is loosened;

an adjustable transverse support consisting essentially of a plurality of rigid integral spaced apart leg supports and including an integral compression clamp mechanism utilizing radial compression and slidably coupled to said elongated shaft for adjusting the placement of said transverse support on said elongated shaft and for locking said transverse support thereon, wherein said leg support is locked to said device when said compression clamp is tightened, wherein said leg support is slidably adjustable on said device when said compression clamp is loosened, and wherein said leg supports laterally extend from opposite sides of said transverse support;

a floor mount detachably connected to the floor for receiving said distal end of said elongated shaft;

rubber end caps located on said proximal end and said distal end of said elongated shaft; and a plurality of cushion pads surrounding said plurality of leg supports for comfortably supporting body parts.

* * * * *